US007518525B2

(12) United States Patent
Chou

(10) Patent No.: US 7,518,525 B2
(45) Date of Patent: Apr. 14, 2009

(54) LIGHT EMITTING DIODE AND DISPLAY DEVICE USING THE SAME

(75) Inventor: Yi-Chung Chou, Taipei (TW)

(73) Assignee: ITE Tech. Inc., Hsinchu (TW)

( * ) Notice: Subject to any disclaimer, the term of this patent is extended or adjusted under 35 U.S.C. 154(b) by 293 days.

(21) Appl. No.: 11/623,092

(22) Filed: Jan. 15, 2007

(65) Prior Publication Data

US 2008/0106505 A1 May 8, 2008

(30) Foreign Application Priority Data

Nov. 6, 2006 (TW) ..... 95140944 A

(51) Int. Cl.
*G08B 5/22* (2006.01)
*G09F 9/33* (2006.01)

(52) U.S. Cl. ..... 340/815.45; 340/815.52; 315/291; 315/313; 315/307

(58) Field of Classification Search ..... 340/815.45, 340/815.4, 815.52, 815.56, 691.1, 691.4, 340/691.6, 653, 654; 315/291, 313, 314, 315/315, 320, 321, 362, 129, 133, 307; 345/83, 345/39, 44, 46, 48, 82

See application file for complete search history.

(56) References Cited

U.S. PATENT DOCUMENTS 4,866,430 A * 9/1989 Chek ..... 345/82
5,590,652 A * 1/1997 Inai ..... 600/323
6,686,706 B1 * 2/2004 Liao ..... 315/291
7,466,082 B1 * 12/2008 Snyder et al. ..... 315/200 A

* cited by examiner

*Primary Examiner*—Toan N Pham
(74) *Attorney, Agent, or Firm*—Jianq Chyun IP Office

(57) ABSTRACT

An LED driver and a display device using the same are disclosed. The LED driver is adapted for driving a first set of LEDs and a second set of LEDs. The LED driver includes an inductor, a main switch, a first switch, a second switch, and a controller. The inductor has a first terminal receiving an input voltage. The main switch is coupled between a second terminal of the inductor and a common level for adjusting a current flowing therethrough. The first switch is coupled between the first set of LEDs and the second terminal of the inductor. The second switch is coupled between the second LEDs and the second terminal of the inductor. The controller is coupled to controlling terminals of the main switch, the first switch, and the second switch respectively for controlling conducting statuses of the main switch, the first switch, and the second switch respectively.

14 Claims, 3 Drawing Sheets

LIGHT EMITTING DIODE AND DISPLAY DEVICE USING THE SAME

CROSS-REFERENCE TO RELATED APPLICATION

This application claims the priority benefit of Taiwan application serial no. 95140944, filed on Nov. 6, 2006. All disclosure of the Taiwan application is incorporated herein by reference.

BACKGROUND OF THE INVENTION

1. Field of the Invention

The present invention generally relates to a display driver, and more particular, to a light emitting diode (LED) driver and a display device using the same.

2. Description of Related Art

Recently, many electronic products are equipped with displays, such as mobile phones, personal digital assistants (PDAs), digital music players, and automobile instrument panels. Types and sizes of the displays are usually designed according to their practical applications. However, almost all displays including liquid crystal displays (LCDs) need backlight modules to provide backlight illumination thereto, and thus designers must design illumination circuits for the displays for allowing users to clearly view patterns and letters displayed thereon. LEDs are often adopted in current electronic products as illumination devices. Generally, three or four or even more LEDs are needed for a uniform backlight provision for a colourful LCD, and six or more LEDs are required for an instrument panel backlight provision. As demand for LEDs increases, market for LED drivers is drastically driven to increase accordingly.

FIG. 1 is a circuit of a conventional device. Referring to FIG. 1, the conventional device uses a backlight module 100. The backlight module includes LED drivers 110, 120, and 130 respectively including red, green and blue LED sets 113, 123, and 133. As shown in FIG. 1, all circuits for respective LED drivers 110, 120 and 130 are conventional boost circuit. Each of the LED sets 113, 123, and 133 are composed of serially connected LEDs of same color. In other words, a controller 117 can be used to control a loop composed of only one switch 112 and one feedback circuit 115. Therefore, the boosting of the LED driver 110 can be realized by driving only a single loop to control a single LED set 113.

The aforementioned three LED drivers 110, 120, and 130 have same circuit structures. Each of the three LED drivers 110, 120, and 130 can independently adjust the input voltage VI, providing respective corresponding LED sets 113, 123, and 133 an independent adjustment current. For example, the LED driver 110 is composed of the controller 117, a main switch 116, an inductor 111, the switch 112, the feedback circuit 115, and a voltage stabilizing circuit 114.

Because one LED driver can drive only one LED set, three LED sets require three LED drivers when LED sets of three different colors are needed for driving. LED sets of different colors also require different voltage drop, according to which inductances of respectively the inductors 111, 121, and 131 are selected.

Therefore, conventional device requires one independent LED driver for driving each LED set. As such, although simple, such a conventional device has LED drivers, whose area proportionally increases as the LED sets increases.

In summary, a disadvantage the convention technology for LED drivers is that it can control a single loop, thus each LED set requires individually designed LED driver. Such a conventional technology requires relatively large area for circuit. Accordingly, issues to be considered when designing products having LED drivers are: larger circuit area causes greater product's bulkiness; usage of more LED drivers increase production cost. Accordingly, conventional technology unfortunately requires too much circuit elements that occupies too much circuit area. As such, the circuit board thereof becomes very complicated. When also considering the greater bulkiness, such LED drivers are inconvenient for application.

SUMMARY OF THE INVENTION

Accordingly, the present invention is directed to an LED driver capable of driving multiple LED sets, wherein the number of circuit elements used therein is effectively reduced.

The present invention is also directed to a display device including elements for driving multiple LED sets, and thereby increase element usage efficiency.

The present invention provides an LED driver for driving at least a first set of LEDs and a second set of LEDs. The LED driver includes an inductor, a main switch, a first switch, a second switch and a controller. The inductor has a first terminal for receiving an input voltage. The main switch is coupled between a second terminal of the inductor and a common voltage level for adjusting a current flowing through the inductor. The first switch is coupled between the first set of LEDs and the second terminal of the inductor. The second switch is coupled between the second set of LEDs and the second terminal of the inductor. The controller is coupled to control terminals of the main switch, the first and the second switches respectively. The controller is adapted for controlling conducting status of the main switch, the first and the second switches, respectively.

The present invention is also directed to a display device including a backlight module. The backlight module includes a first set of LEDs, a second set of LEDs, an inductor, a main switch, a first switch, a second switch and a controller. The inductor has a first terminal for receiving an input voltage. The main switch is coupled between a second terminal of the inductor and a common voltage level for adjusting a current flowing through the inductor. The first switch is coupled between the first set of LEDs and the second terminal of the inductor. The second switch is coupled between the second set of LEDs and the second terminal of the inductor. The controller is coupled to control terminals of the main switch, the first and the second switches respectively. The controller is adapted for controlling conducting status of the main switch, the first and the second switches, respectively.

According to preferred embodiments of the present invention, the LED driver and the display device using the same further includes a first feedback circuit and a second feedback circuit. The first feedback circuit has a first terminal coupled to the first set of LEDs and the controller, and a second terminal coupled to a common voltage level. The second feedback circuit has a first terminal coupled to the second set of LEDs and the controller, and a second terminal coupled to the common voltage level. The controller is adapted for controlling conducing times respectively of the first and the second switches according to the voltages at the first terminals of respectively the first feedback circuit and the second feedback circuit.

According to an embodiment of the present invention, the common voltage level associating with the LED driver and the display device using the same is a ground level, and the main switch is a N-type transistor.

According to a preferred embodiment of the present invention, the LED driver and the display device using the same further includes a first and a second voltage stabilizing circuits. The first voltage stabilizing circuit is coupled between the first terminal of the first switch and the common voltage level. The second voltage stabilizing circuit is coupled between the first terminal of the second switch and the common voltage level.

According to a preferred embodiment of the present invention, the first set of LEDs and the second set of LEDs are of different colors.

According to a preferred embodiment of the present invention, the LED driver and the display device using the same further includes a third switch. The third switch has a first terminal coupled to a third set of LEDs, a second terminal coupled to the second terminal of the inductor, and a control terminal coupled to the controller. The controller controls the conducting status of the third switch.

According to a preferred embodiment of the present invention, the first, second, and the third set of LEDs are of red, green, and blue colors respectively.

The present invention requires only one main switch, one inductor, and one controller regardless of the number of sets of LEDs to be driven. Thus, the LED driver of the present invention is capable of not only reducing the cost and the bulkiness of the display but also simplify the circuit design of the LED driver circuit. As such, the LED driver is applied in portable consumer electronic products.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
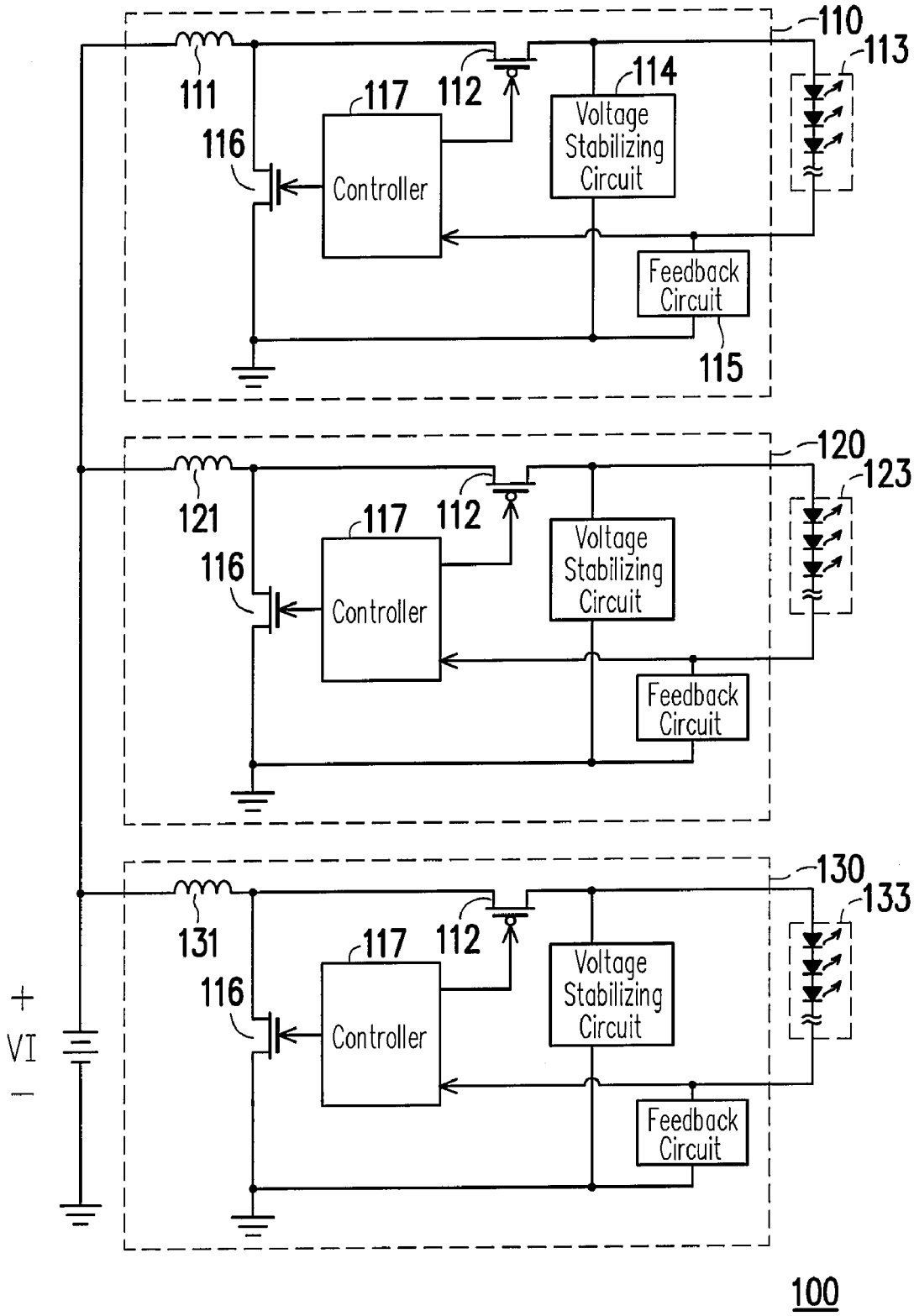
FIG. 1 is a circuit diagram of a conventional device.

Reference will now be made in detail to the present preferred embodiments of the invention, examples of which are illustrated in the accompanying drawings. Wherever possible, the same reference numbers are used in the drawings and the description to refer to the same or like parts.

As described above, the conventional display device requires an independent LED driver circuit for driving an LED set. When the quantity of LED sets increases, correspondingly more number of LED drivers is required. Thus, the number of elements used therein increase accordingly, and circuit elements occupy a larger area on the circuit board. The present invention provides an LED driver including comparatively fewer circuit elements. The LED driver of the present invention will be described below in association with the following preferring embodiments.

Figure 2:
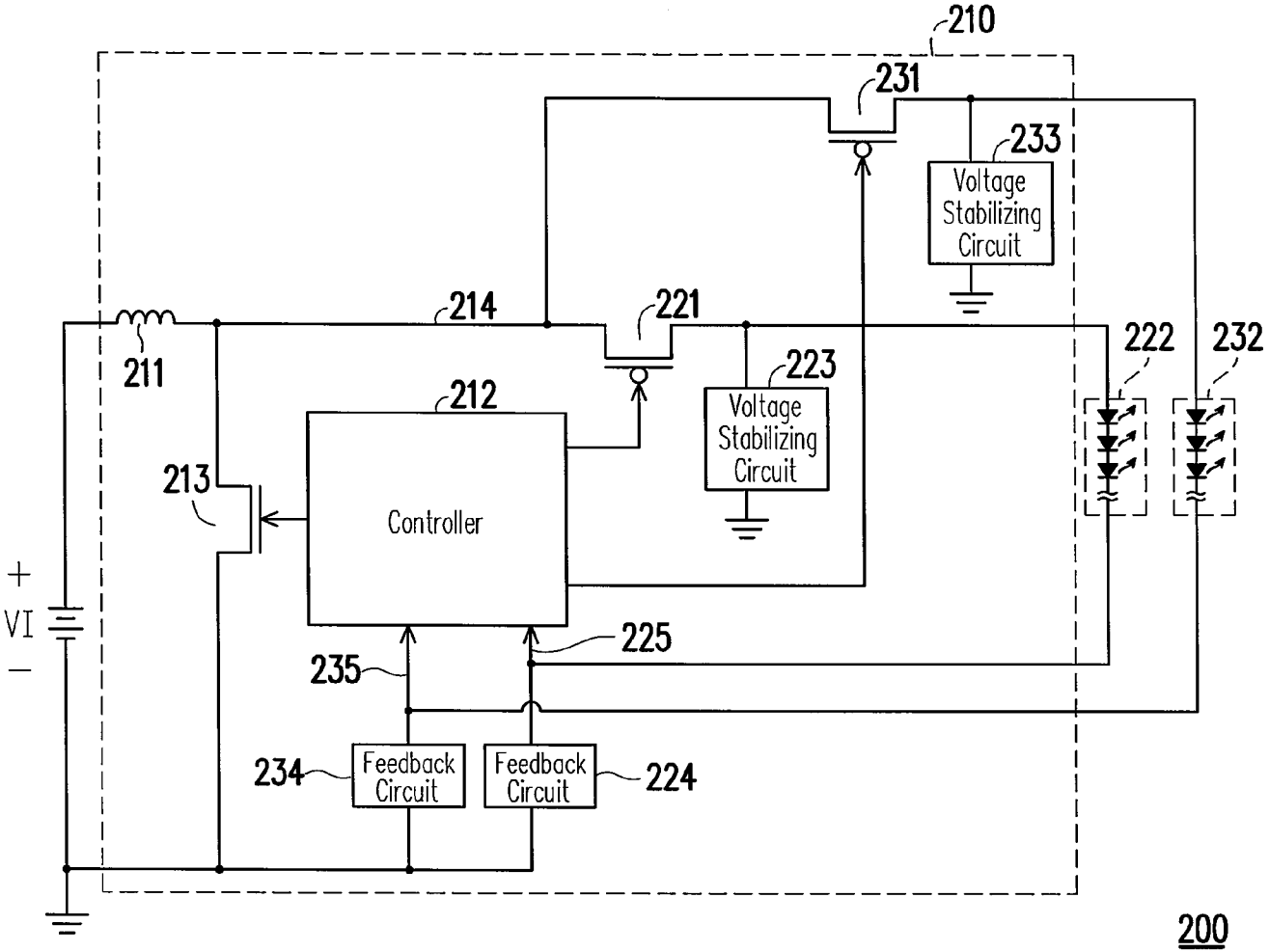
FIG. 2 is a circuit diagram of a display device according to an embodiment of the present invention.

FIG. 2 is a circuit diagram of a display device according to an embodiment of the present invention. Referring to FIG. 2, the display device includes a backlight module 200. The backlight module 200 includes an LED driver 210, LED sets 222, 232. The LED driver 210 includes an inductor 211, a main switch 213, switches 221, 231, a controller 212, voltage stabilizing circuits 223, 233, and feedback circuits 224, 234.

The backlight module 200 includes two LED sets 222 and 232. The two LED sets 222 and 232 may be either both composed of serially connected same kind of LEDs, or two different kinds of LED sets. Those using same kind of LEDs, e.g., white light LED, can be used as white backlight module for the display device. Those using different kinds of LEDs, or using same kind while the quantities of the serially connected LEDs are different from one to another, require different driving voltages. Therefore, the controller 212 of the LED driver 210 controls two independent loops, i.e., output loops for boost voltages of different requirements for switches 221, 231.

The LED sets 222 and 232 are composed of serially connected LEDs. Therefore, the amount of current flowing through each of the LEDs is same, thus luminance obtained thereby is uniform. According to an embodiment of the present invention, the LEDs are serially connected to each other, and therefore the voltage drops of the LEDs are positively accumulated. As such, the LED sets 222 and 232 need higher voltages for driving. Furthermore, if that the LED driver 210 is applied in a portable electronic device, and the input voltage VI is provided by a battery, the input voltage decreases from the time when the battery is connected to the circuit until the power of the battery is used out. Therefore, the LED driver 210 boosts voltages by a method of converting direct current to direct current.

The LED sets 222 and 232 include an inductor 211. In accordance with the maximum voltage of voltages needed for driving these two LED sets 222 and 232, the inductor 211 is selected in consideration of a rated output voltage 214 and a certain degree of safety tolerance. In this way, a relatively high efficiency can be obtained in driving and good insulation and power safety are well guaranteed, by granting the input voltage VI an appropriately wide operation range.

A programmable controller 212 is employed in the LED driver 210. The programmable controller 212 sets a program to in times or in turns adjust one of the two sets of LEDs 222 and 232 to perform a close loop control. In other words, although there are two sets of LEDs 222 and 232, the controller 212 conducts only one of them each time. In order to maintain a current for adjusting the LED sets 222 and 232, the controller 212 keeps alternately checking a loop voltage 225 between the controller 212 and the feedback circuit 224, and checks a loop voltage 234 between the controller 212 and the feedback circuit 234. The controller 212 further adjusts the output voltage 214 that controls one of the two LED sets 222 and 232, and controls conducting duty cycles of the main switch 213, and switches 221 and 231 with a program. Thus, the output current is adjusted.

In designing such a feedback control, the controller 212 carries out an error comparison of one or more reference voltages therein with the loop voltage 225 or 235. As in the present embodiment, if the LED sets 222 and 232 are of different colors respectively, the conducting voltages thereof and the driving voltages being different accordingly, the controller 212 must provides two different references corresponding to the loop circuit 224 and 234, respectively. If the loop voltage 225 is smaller than its corresponding reference voltage, when the error increases, the controller 212 adjusts the conducting duty cycle of the corresponding switch 221 according to the error to allow more current for outputting.

It is to be noted that although only one embodiment is illustrated herein, those of ordinary skilled in the art should understand that when talking about the aforementioned driving LED sets of different colors, the above-described effect can also be obtained by changing the design of the feedback circuits 234 and 224, if only one reference voltage is provided.

The controller 212 is programmed to shift the switches in a high speed. The controller 212 controls the duty cycle of the main switch 213 for adjusting the current flowing through the inductor 211, thus boosting voltage to have power stored thereby. When controlling the main switch 213 to turn off, the controller 212 is able to output the voltage 214 of a level suitable for driving the LED sets 222 and 232, according to the direct current of the inductor 211 after being boosted. The main switch 213 can be a transistor, and preferably an N-channel metal-oxide-semiconductor field-effect transistor (NMOS). The controller 212 controls duty cycles of the switches 221 and 231 for adjusting the currents flowing through the LED sets 222 and 232, so as to obtain uniform luminance. Therefore, according to the present invention, the controller 212 integrates functions of boosting voltage and adjusting current. The controller 212 enables the LED driver 210 to independently adjust the current of the LED sets 222 and 232. The controller 212 can control the duty cycles of the switches 221 and 231, e.g., by changing designed current percentage to adjust luminance.

There are two specific circuit protection designs proposed for the LED driver 210. The first is corresponding possible open circuit failure of LED sets 222 and 232. The LED driver 210 therefore requires an overloading voltage protection functionality and accordingly the LED driver 210 further includes a voltage stabilizing circuits 223 and 233. The second is to use the controller 212 to limit the maximum output voltage 214 with the LED driver 210.

When the LED driver 210 provides a fixed current to each of the LED sets for driving it to emit light, the controller 212 boosts the input voltage VI until a predetermined boosting voltage level reaches the output voltage 214. However, at this time, without protection of the voltage stabilizing circuits 223 and 233, an overly high output voltage 214 is likely to damage elements of the circuits. Furthermore, the controller 212 is designed according to the voltages measured from both ends of each of the feedback circuits 224 and 234 to limit the maximum output voltage 214 and protect the LED driver 210 being damaged.

When a backlight adjustment functionality is needed, the LED set 222 is taken as an example, wherein the controller 212 of the LED driver 210 provides an full current to the LED set 222, and shortens the duty cycle thereof to adjust the backlight, e.g., to reduce 25% of the luminance, the duty cycle of providing the full current is reduced to 75%, or reduced to a half of the luminance where only 50% of the duty cycle is needed.

Figure 3:
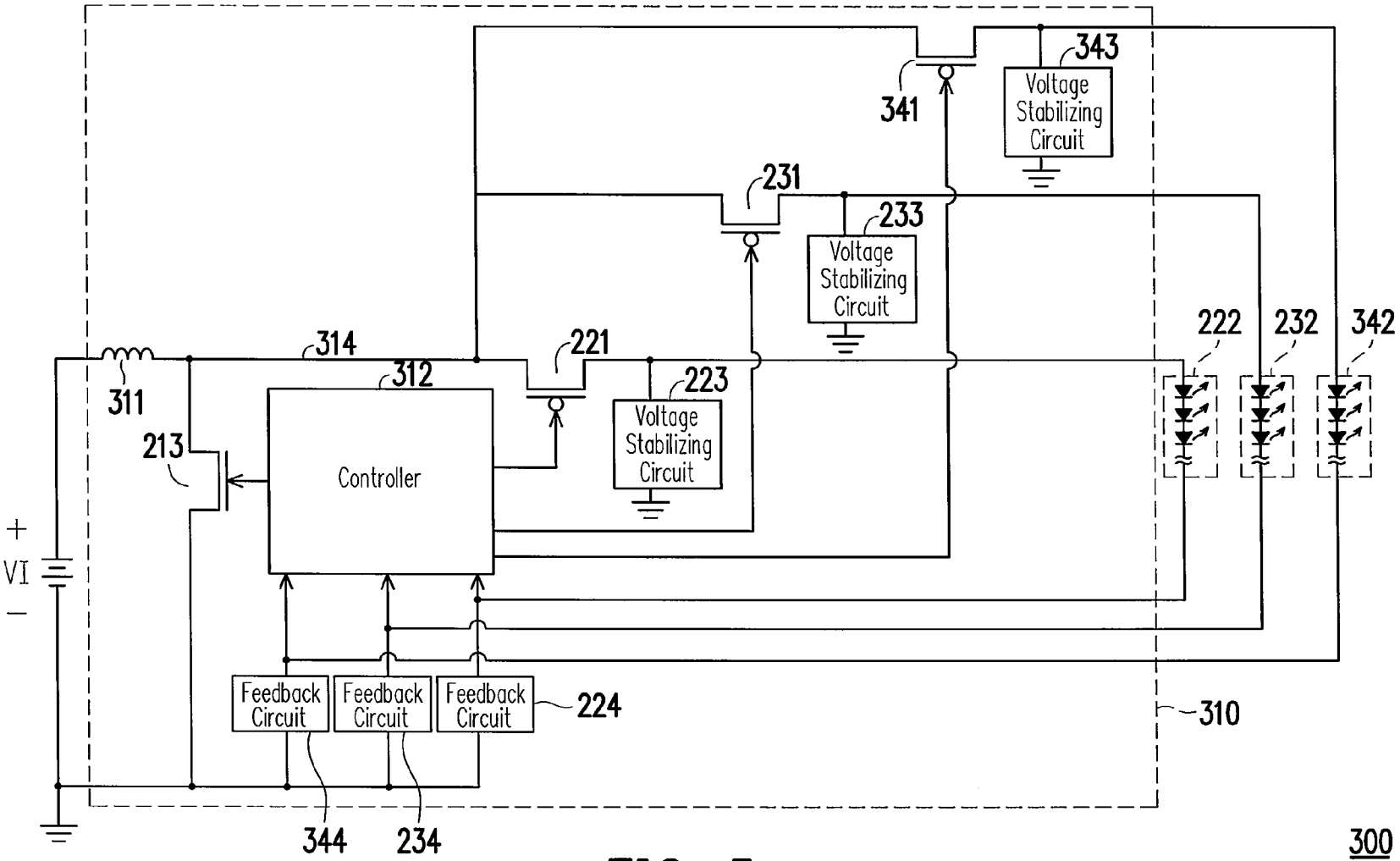
FIG. 3 is a circuit diagram of a display device according to another embodiment of the present invention.

FIG. 3 is a circuit diagram for a display device according to another embodiment of the present invention. The display device includes a backlight module 300. The backlight module 300 includes an LED driver 310, and LED sets 222, 232 and 342. The LED driver 310 includes an inductor 311, a main switch 213, switches 221, 231 and 341, a controller 312, voltage stabilizing circuits 223, 233 and 343, and feedback circuits 224, 234 and 344.

Referring to FIG. 3 and comparing with the LED driver 210 of FIG. 2, the controller 312 of the LED driver 310 is a driving circuit including one more LED sets 342. The controller 312 controls three independent loops including direct current output voltage loops of the three switches 221, 231 and 341. Therefore the controller 312 drives three LED sets 222, 232 and 342. It is preferred that the LED sets 222, 232 and 342 are of red, green and blue colors, respectively. Such three colors can be used in the display device shown in FIG. 3 as a backlight source or for other purposes.

Because the LED sets 222, 232 and 342 use the common inductor 311, the controller 312 controls the inductor 311 to have three predetermined voltage boosting levels. The inductor is selected according to the maximum voltage needed among these three LED sets to provide the rating output voltage 314 for convenience of providing the input voltage VI a relatively wide operation range to provide a certain degree of tolerance. In such a way, higher efficiency can be obtained in voltage boosting/lowering driving operation, with well maintained insulation and safety.

As shown in FIG. 3, the display device 300 is similar to the display device 200 of FIG. 2 with one additional LED sets. The method of driving the LED sets, controlling method and circuit protection method for driving each of the loops are same as that of the FIG. 2, and therefore will not be iterated herein.

If, for example, more LED sets are required in the display device 300, those of ordinary skill in the art may easily deduce the design in accordance with the description of the above embodiments, which is also construed to be within the scope of the present invention.

The configurations of circuit elements of LED sets 222, 232 and 342 including red, green and blue colors may compared with the configurations of circuit elements of LED sets 113, 123 and 133 including red, green and blue colors may be compared as follows.

First, with respect to the number of controllers, the conventional technology requires three controllers 117, while the present invention requires only one controller 312 for controlling all of the switches and detecting all the loops.

Secondly, with respect to the number of the inductors, the conventional technology requires three inductors 111, 121 and 131, while the present invention requires only one inductor 311.

Finally, with respect to the number of the main switches, the conventional technology requires three main switches, while the present invention requires only one main switch 213.

Accordingly, circuit area occupied by the LED driver is reduced, and the circuit elements can be more efficiently arranged, and the complexity of circuit board arrangement can be simplified. Thus, the applications of the LED drivers of the present invention can be increased.

In summary, the above embodiments of the present invention, the LED drivers of the present invention have the advantages of being capable of controlling two or more LED sets according to practical requirements, driving white or colorful backlight source; designing the controller with programs to drive the LED sets; including an overloading protection functionality; adjusting the currents of the LED sets; shifting the main switch and other switches in a high speed; driving more than two serially connected LEDs; and detecting an overly high voltage. Thus, the disadvantages of the conventional technology, for example, requiring too many circuit elements for the LED driver may be effectively eliminated.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An LED driver, for driving a first set of LEDs and a second set of LEDs, comprising:

an inductor, having a first terminal, for receiving an input voltage;

a main switch, having a first terminal coupled to a second terminal of the inductor and a second terminal coupled to a common level, for adjusting a current of the inductor;

a first switch, having a first terminal coupled to the first set of LEDs and a second terminal coupled to the second terminal of the inductor;

a second switch, having a first terminal coupled to the second set of LEDs and a second terminal coupled to the second terminal of the inductor; and a controller, coupled to controlling terminals of the main switch, the first switch and the second switch respectively, for controlling conducting statuses thereof.

2. The LED driver according to claim 1, further comprising:

a first feedback circuit, having a first terminal coupled to the first set of LEDs and the controller, and a second terminal coupled to the common level; and a second feedback circuit, having a first terminal coupled to the second set of LEDs and the controller, and a second terminal coupled to the common level, wherein the controller controls duty cycles of the first switch and the second switch respectively according to voltages of the first terminals of the first feedback circuit and the second feedback circuit respectively.

3. The LED driver according to claim 1, wherein the common level is a grounded level, and the main switch is a N-type transistor.

4. The LED driver according to claim 1, further comprising:

a first voltage stabilizing circuit, coupled between the first terminal of the first switch and the common level; and a second voltage stabilizing circuit, coupled between the first terminal of the second switch and the common level.

5. The LED driver according to claim 1, wherein the first set of LEDs and the second set of LEDs are adapted to emit light of different colors.

6. The LED driver according to claim 1, further comprising:

a third switch, having a first terminal coupled to a third set of LEDs, a second terminal coupled to the second terminal of the inductor and a controlling terminal coupled to the controller, wherein the controller is adapted for controlling a duty cycle of the third switch.

7. The LED driver according to claim 6, wherein the first set of LEDs, the second set of LEDs, and the third set of LEDs are adapted for emitting red color light, green color light and blue color light respectively.

8. A display device, comprising:

a backlight module, comprising:

a first set of LEDs;

a second set of LEDs;

an inductor, having a first terminal receiving an input voltage;

a main switch, having a first terminal coupled to a second terminal of the inductor, and a second terminal coupled to a common level, for adjusting a current of the inductor;

a first switch, having a first terminal coupled to the first set of LEDs, and a second terminal coupled to the second terminal of the inductor;

a second switch, having a first terminal coupled to the second set of LEDs, and a second terminal coupled to the second terminal of the inductor; and a controller, coupled to controlling terminals of the main switch, the first switch and the second switch, respectively, for controlling conducting statuses thereof.

9. The display device according to claim 8, further comprising:

a first feedback circuit, having a first terminal coupled to the first set of LEDs and the controller, and a second terminal coupled to the common level; and a second feedback circuit, having a first terminal coupled to the second set of LEDs and the controller, and a second terminal coupled to the common level, wherein the controller controls duty cycles of the first switch and the second switch respectively according to voltages of the first terminals of the first feedback circuit and the second feedback circuit respectively.

10. The display device according to claim 8, wherein the common level is a grounded level, and the main switch is a N-type transistor.

11. The display device according to claim 8, further comprising:

a first voltage stabilizing circuit, coupled between the first terminal of the first switch and the common level; and a second voltage stabilizing circuit, coupled between the first terminal of the second switch and the common level.

12. The display device according to claim 8, wherein the first set of LEDs and the second set of LEDs are adapted to emit light of different colors.

13. The display device according to claim 8, further comprising:

a third switch, having a first terminal coupled to a third set of LEDs, a second terminal coupled to the second terminal of the inductor, and a controlling terminal coupled to the controller, wherein the controller is adapted for controlling a duty cycle of the third switch.

14. The display device according to claim 13, wherein the first set of LEDs, the second set of LEDs, and the third set of LEDs are adapted for emitting red color light, green color light and blue color light respectively.

* * * * *